US005689093A

United States Patent [19]

Sun

[11] Patent Number: 5,689,093

[45] Date of Patent: Nov. 18, 1997

[54] CONE OF A SPEAKER

[76] Inventor: Cheng-Yuan Sun, P.O. Box 82-144, Taipei, Taiwan

[21] Appl. No.: 593,707

[22] Filed: Jan. 29, 1996

[51] Int. Cl.[6] ..... G10K 13/00

[52] U.S. Cl. ..... 181/157; 181/166; 181/169

[58] Field of Search ..... 181/166, 167, 181/168, 169, 171, 172, 157

[56] References Cited

U.S. PATENT DOCUMENTS

| | | | |
|---|---|---|---|
| 1,689,513 | 10/1928 | Zimmerman | 181/166 |
| 1,775,064 | 9/1930 | Brown | 181/166 |
| 1,815,987 | 7/1931 | Peterson | 181/166 |
| 2,071,829 | 2/1937 | Glen | 181/166 |
| 3,424,873 | 1/1969 | Walsh | 181/166 |
| 4,395,598 | 7/1983 | Lesage | 181/172 X |
| 5,304,746 | 4/1994 | Purvine | 181/166 X |

*Primary Examiner*—Khanh Dang
*Attorney, Agent, or Firm*—Alfred Lei

[57] ABSTRACT

The cone of a speaker which has fibers perpendicularly fastened thereto by an electrostatic fiber implanting apparatus to eliminate the reflection of transverse waves between the diaphragm and the peripheral flange of the cone.

5 Claims, 4 Drawing Sheets

CONE OF A SPEAKER

BACKGROUND OF THE INVENTION

1. Field of the Invention

This invention relates to speakers, and relates more particularly to the cone of a speaker which is fastened with fibers that effectively eliminate the reflection of transverse waves during the operation of the speaker.

2. Description of the Prior Art

A regular speaker, as shown in FIG. 6, is generally comprised of a casing 11, a magnetic loop device 21 at the bottom of the casing 11, a sound coil 31 disposed above the magnetic loop device 21 and coupled to the cone 41 inside the casing 11, and a diaphragm 71 at the center of the cone 41. During the operation of the speaker, the magnetic loop device 21 produces a fixed magnetic field, the sound coil 31 is energized to act with the magnetic field, causing the cone 41 vibrated in accordance with the variation of electric current passing to the sound coil 31. The vibration of the come 41 causes a synchronous movement of air, and therefore sound waves are produced. As illustrated in FIG. 7, the cone 41 has a peripheral flange 51 connected to the casing 11. However, because the cone 41 and the flange 51 are made from different materials, transverse waves will be reflected to the cone 41 during the vibration of the cone 41. Furthermore, because the cone 41 and the diaphragm 71 are also made from different materials, a sound wave reflection will occur during the vibration of the cone 41. The reflection of waves greatly interferes with the quality of sound. In order to eliminate this problem, a layer of damping paint may be coated over the cone, or a multi-layer cone may be used. However, these arrangements greatly increase the manufacturing cost of the speaker.

SUMMARY OF THE INVENTION

This invention is directed to an improved cone of a speaker.

It is the primary object of the present invention to provide a speaker which eliminates the reflection of waves during the operation.

It is another object of the present invention to provide a speaker which is inexpensive to manufacture. According to the present invention, fibers are perpendicularly fastened to one side of a single layer cone or both sides of a double-layer cone by an electrostatic fiber implanting apparatus to eliminate the interference of transverse waves.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENTS

Figure 1:
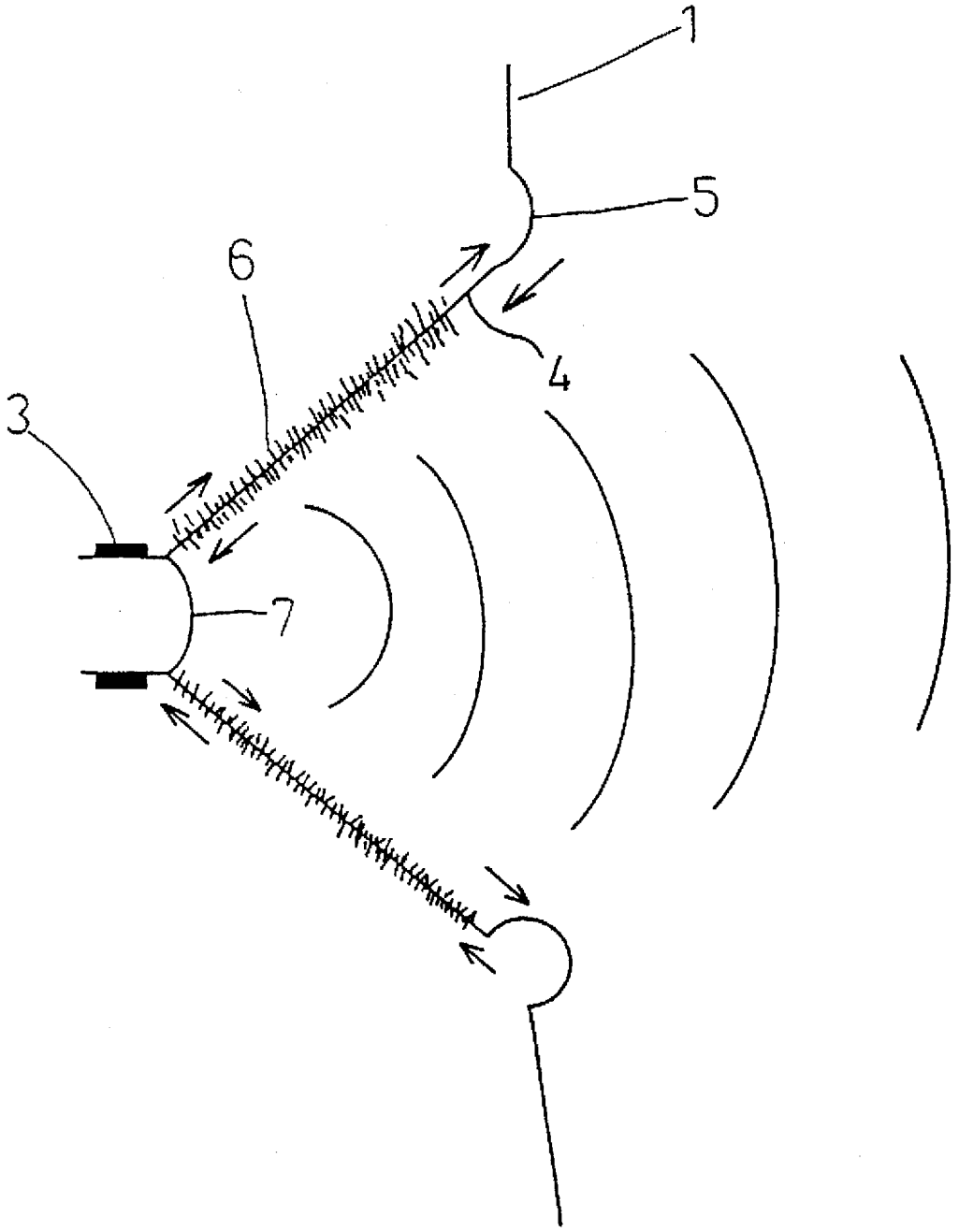
FIG. 1 is a schematic drawing of the present invention, showing the cone vibrated.

For the purpose to promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Referring to FIG. 1, a speaker in accordance with the present invention is generally comprised of a casing 1, a magnetic loop device (not shown) at the bottom of the casing 1, a sound coil 3 disposed above the magnetic loop device and coupled to the cone 4 inside the casing 1, and a diaphragm 7 at the center of the cone 4. Fibers 6 are perpendicularly fastened to both sides of the cone 4 by an electrostatic fiber implanting apparatus. Because of the effect of electrostatic repulsion, the fibers are separately upstanding from the surface of the cone 4, and disposed in the vibrating direction of the cone 4 and perpendicular to the transverse waves which are produced due to different materials of the peripheral flange 5 and the sound coil 3. Therefore, the fibers 6 can effectively stop the transmission of transverse waves, and the quality of sound can be maintained stable. Because the cost of the implantation of fiber by an electrostatic fiber implanting apparatus is inexpensive, the implantation of fiber affects little the manufacturing cost of the speaker.

Figure 3:
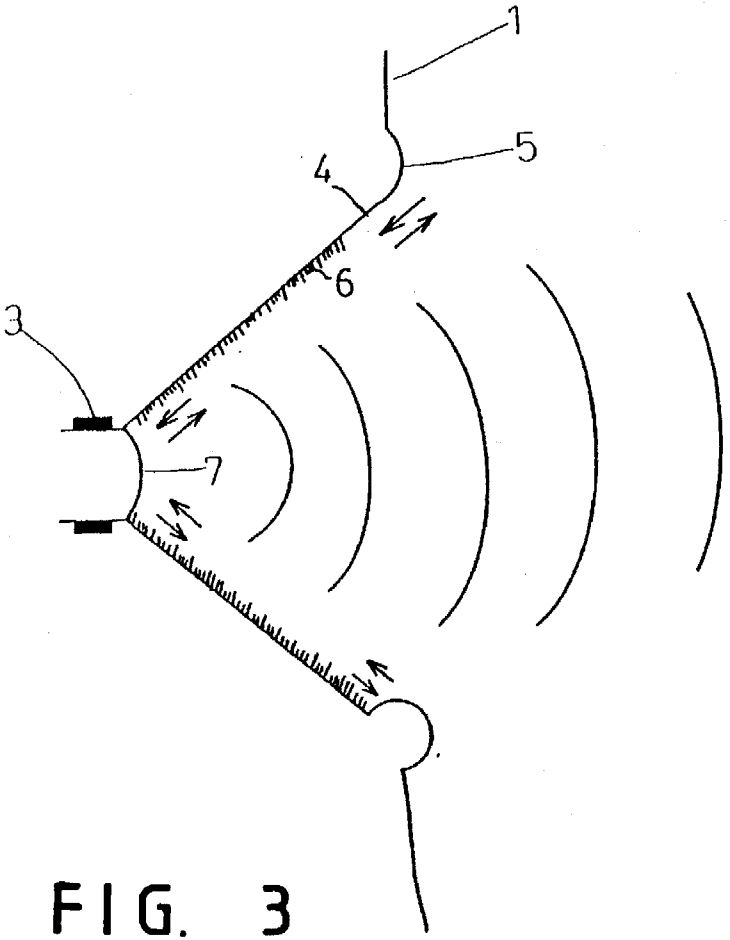
FIG. 3 shows another alternate form of the present invention.
Figure 2:
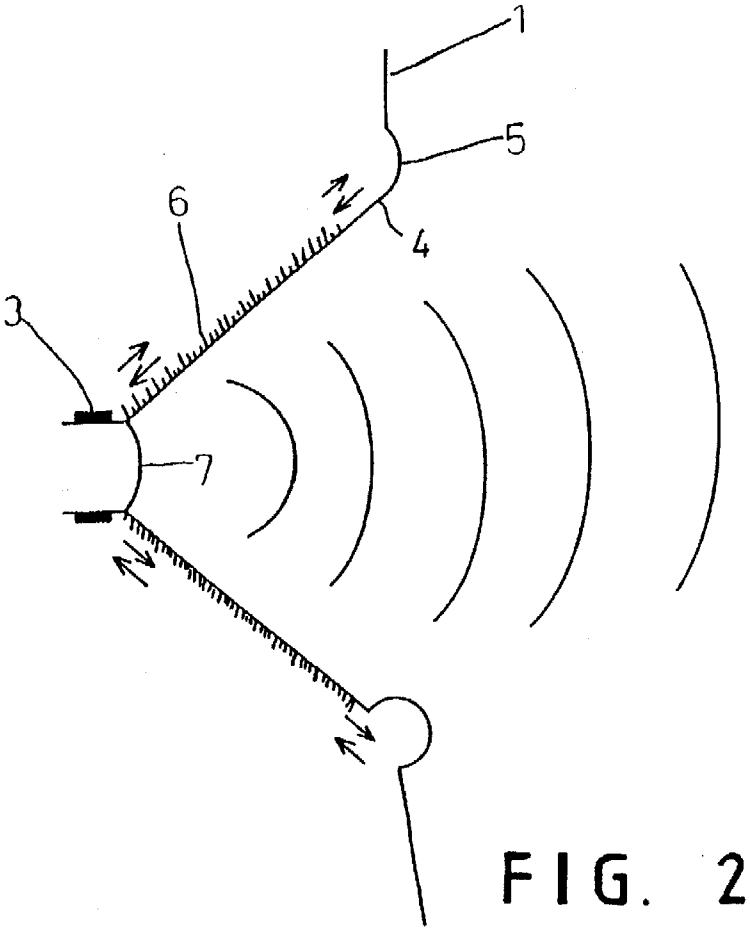
FIG. 2 shows an alternate form of the present invention.

FIGS. 2 and 3 show two alternate forms of the present invention. In case the cone 4 is a single layer structure, the fibers 6 can be fastened to outer side of the cone 4 only (see FIG. 2), or the inner side of the cone 4 only (see FIG. 3).

Figure 4:
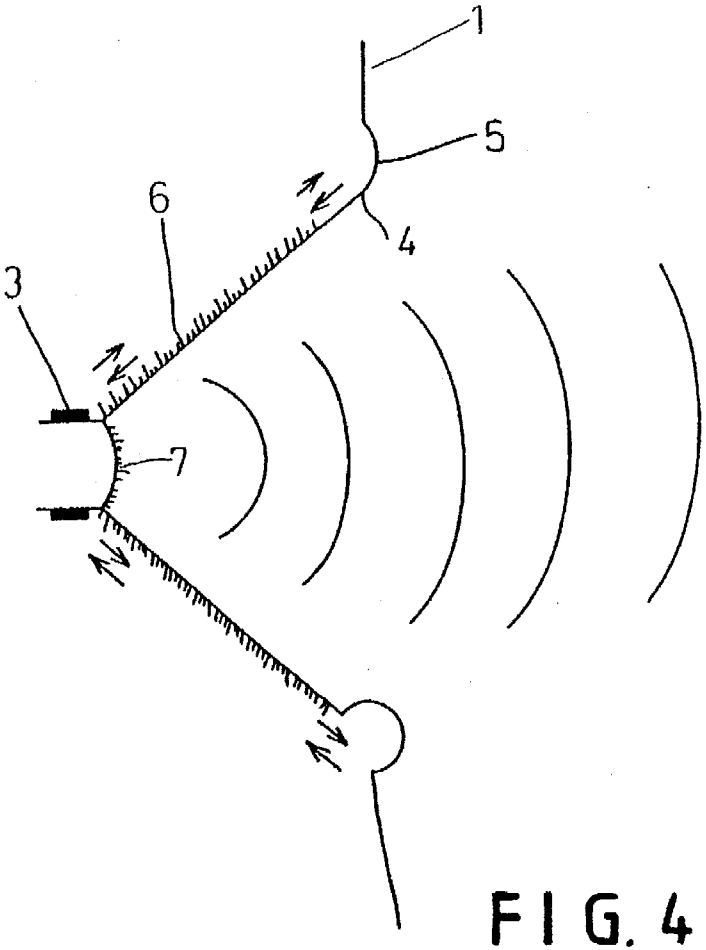
FIG. 4 shows still another alternate form of the present invention.
Figure 6:
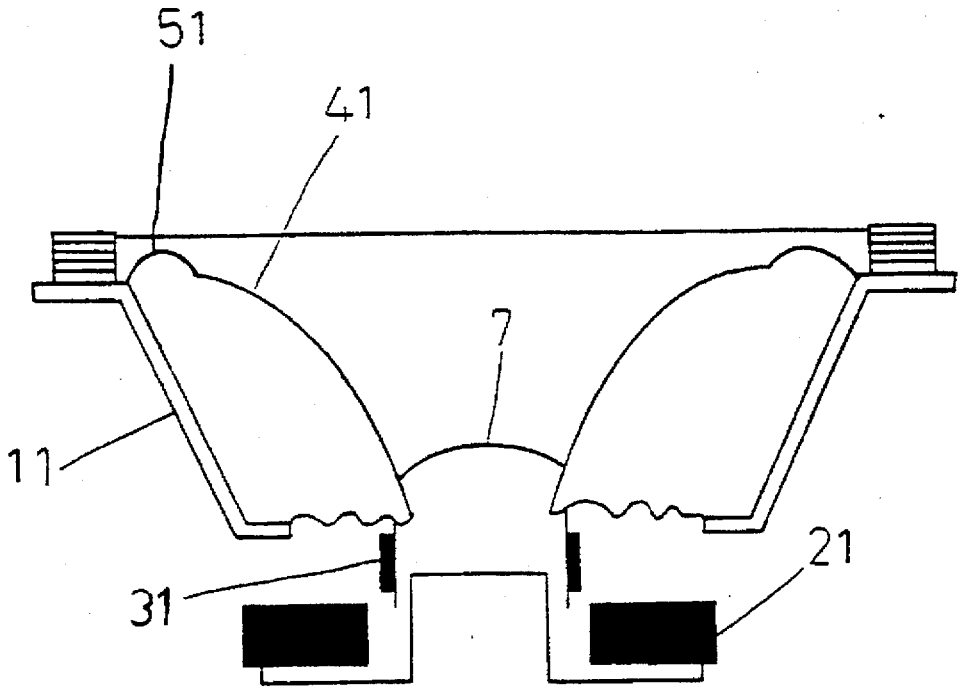
PRIOR ART FIG. 6
FIG. 6 shows the structure of a conventional speaker.
Figure 7:
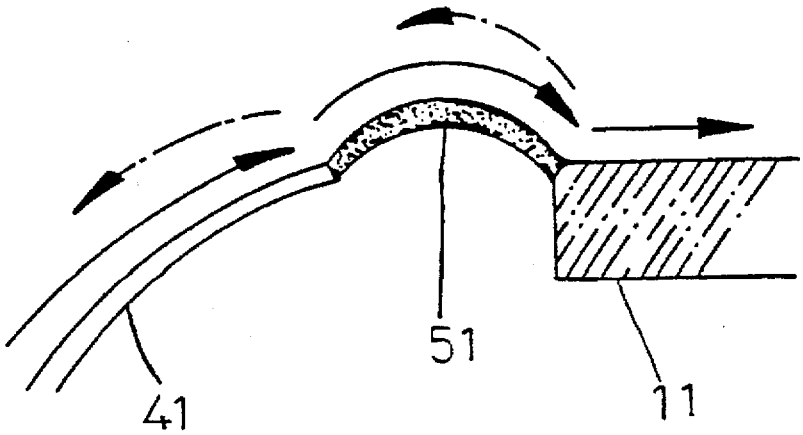
PRIOR ART FIG. 7
FIG. 7 is a partial view in an enlarged scale of FIG. 6, showing the reflection of waves.

FIG. 4 shows still another alternate form of the present invention, in which the fibers 6 are fastened to the inner side of the cone 4 and the outer side of the diaphragm 7.

Figure 5:
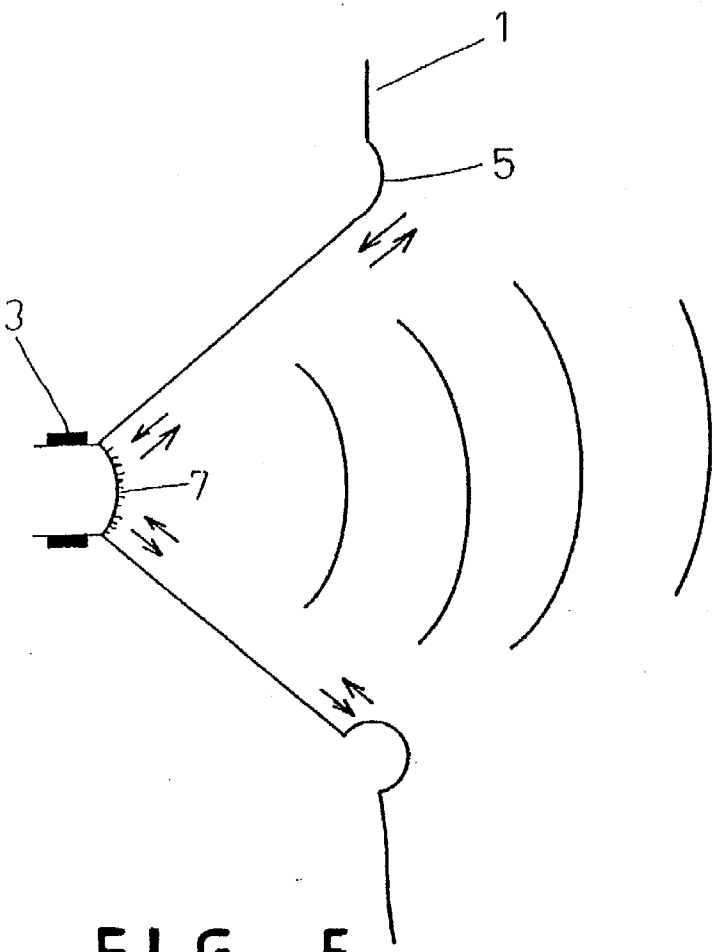
FIG. 5 shows a yet further alternate form of the present invention.

FIG. 5 shows still another alternate form of the present invention, in which the fibers 6 are simply fastened to the outer side of the diaphragm.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A speaker comprising:

a casing;

a cone having a peripheral flanged connected to said casing;

a diaphragm connected to a center of said cone; and a plurality of fibers perpendicularly fastened to at least one side of said cone to eliminate reflection of transverse waves between said diaphragm and said peripheral flanged.

2. The speaker as claimed in claim 1, wherein said fibers are fastened to said cone by an electrostatic fiber implanting apparatus.

3. The speaker as claimed in claim 1, wherein said fibers are fastened to said cone at one side.

4. The speaker as claimed in claim 1, wherein said fibers are fastened to both sides of said cone.

5. The speaker as claimed claim 1, wherein said fibers are additionally fastened to said diaphragm.

* * * * *